United States Patent [19]

Kurose

[11] Patent Number: 4,833,839

[45] Date of Patent: May 30, 1989

[54] PANEL ASSEMBLY

[75] Inventor: Kazutoshi Kurose, Kanagawa, Japan

[73] Assignee: Gomeigaisha Kurose & Co., Hiroshima, Japan

[21] Appl. No.: 225,280

[22] Filed: Jul. 28, 1988

[30] Foreign Application Priority Data

Aug. 7, 1987 [JP] Japan ..... 62-197447
Apr. 12, 1988 [JP] Japan ..... 63-88059

[51] Int. Cl.[4] ..... E04B 5/55

[52] U.S. Cl. ..... 52/39; 52/220; 52/762; 248/343

[58] Field of Search ..... 52/39, 762, 222, 220; 248/342, 343

[56] References Cited

U.S. PATENT DOCUMENTS 2,066,255 12/1936 Dempsey ..... 52/762
2,067,252 1/1937 Whelan ..... 52/222
3,296,251 1/1967 Heirch ..... 52/39

FOREIGN PATENT DOCUMENTS 1469978 2/1967 France ..... 52/222

*Primary Examiner*—John E. Murtagh
*Attorney, Agent, or Firm*—James E. Nilles

[57] ABSTRACT

A panel assembly wherein plurality of upper panels are connected by a plurality of elongated couplers. Each upper panel is made of an elastic material and curved convexly outward at both the side edges thereof and extend in the transverse direction of the panel assembly. Each coupler extends in the transverse direction of the panel assembly and has inner curved surfaces which have curves coincident with those of the upper panels and extend in the face of each other on the upper portion thereof so that a gap, into which two of the upper panels can be inserted, is defined between the inner curved surfaces. A support member having nearly semicircular curve coincident with the curve of the panel and a plurality of couplers is inserted into the gap, so that the support member is fixed to the panels.

6 Claims, 4 Drawing Sheets

PANEL ASSEMBLY

BACKGROUND OF THE INVENTION

1. Field of the Invention

The present invention relates to a panel assembly, and particularly relates to a panel assembly comprising elongated couplers and upper panels.

2. Description of the Prior Art

In a conventional panel assembly, stringers each having a U-shaped cross section extend in the longitudinal direction of the panel assembly and are disposed at intervals in the transverse direction of the panel assembly, projections and recesses are alternately provided on the top of each of the stringer, and upper and lower panels curved as an arc at both the side edges of the panels extend in the transverse direction of the panel assembly and are engaged with the projections and the recesses so that the panel assembly is constituted as a roof material, as disclosed in the Japanese Patent Publication No. 46-3434. However, it is very troublesome to assemble the panel assembly, because it needs to be assembled as described in the Japanese Patent Publication No. 42-26591.

For that reason, it was conceived that the width of each of the recesses of such stringers are made very small and none of lower panels but upper panels were provided to constitute a conventional panel assembly. However, since the panel assembly has no lower panels, none of the members of the panel assembly closes the gap at the joint of the upper panels located between the stringers. For that reason, the panel assembly cannot be used as a roof material.

Although the conventional panel assembly having the upper and the lower panels prevents a light rain from leaking in through the joints of the upper and the lower panels the panel assembly is likely to fail to prevent a heavy rain from leaking in through the joints.

When each of the conventional panel assemblies is to be used as a roof material, a wall material or a ceiling material and fitted with an advertising sign, an illuminator or the like, support members need to be attached to the panel assembly to fit it with the advertising sign, the illuminator or the like. In order to attach the support members to the panel assembly, it is usually needed that holes are made in the panel of the panel assembly and bolts and nuts are provided. For that reason, not only is it very troublesome to attach the support members to the panel assembly, but also rain is likely to leak in through the holes if the panel assembly is used as a roof material.

SUMMARY OF THE INVENTION

The present invention was made in order to solve the above-mentioned problems of the conventional panel assemblies.

Accordingly, it is an object of the present invention to provide a panel assembly characterized by comprising in combination a plurality of upper panels which are made of an elastic material and curved convexly outward at both the side edges of the upper panels and extend in the transverse direction of the panel assembly; and a plurality of elongated couplers, each of which extends in the transverse direction of the panel assembly and has inner curved surfaces which have curves coincident with those of the upper panels and extend in the face of each other on the upper portion of the coupler so that a gap, into which two of the upper panels can be inserted, is defined between the inner curved surfaces.

It is another object of the present invention to provide a panel assembly characterized in combination a plurality of panels which are made of an elastic material and curved convexly outward at both the side edges of the panels and extend in the transverse direction of the panel assembly; support members having nearly semicircular curves coincident with the curves of the panels; and a plurality of couplers, each of which extends in the transverse direction of the panel assembly and has inner curved surfaces which have curves coincident with those of the panels and extend in the face of each other on the upper portion of the coupler so that a gap, into which the curved portions of two of the panels at the side edges thereof and the curved portion of the support member can be inserted, is defined between the inner curved surfaces.

It is still another object of the present invention to provide a method of assembling a panel assembly, which is characterized in that the right-hand curved portion of a first upper panel curved convexly outward at both the side edges thereof and extending in the transverse direction of the panel assembly is engaged with the left-hand inner curved surface in a first pair of the inner curved surfaces of a support provided with a large number of pairs of inner curved surfaces located at small intervals with one another on the top of the support and corresponding to the arc-shaped curves of upper panels; the right-hand curved portion of a second upper panel is then engaged with the left-hand inner curved surface in a second pair of the inner curved surfaces of the support, which neighbors the right-hand inner curved surface in the first pair; the left-hand curved portion of the second upper panel is then placed on the right-hand inner curved surface in the first pair of the inner curved surfaces of the support; the left-hand curved portion of the second upper panel is then engaged with the right-hand inner curved surface in the first pair of the inner curved surfaces of the support by pushing the second upper panel downward at the intermediate part of the width thereof; and such operation is thereafter repeated.

The upper panels of each of these panel assemblies can be very easily and simply engaged with the couplers thereof. Once the upper panels are engaged with the couplers, it is hard to disengage the upper panels from the couplers, because of the mutual contact force of the curved portions of the mutually-adjacent upper panels.

Even if an opening is made between the mutually coupled portions of the upper panels of each of the panel assemblies, the opening is closed by the coupler thereof. For that reason, the panel assembly can be used as a roof material.

Since the couplers of each of the panel assemblies extend in the transverse direction of the panel assembly as well as the upper panels thereof, the couplers can be disposed on a curved supporting surface and fitted with the upper panels as shown in FIG. 4. The use of the panel assembly can thus be widened.

The support members can be very easily and simply engaged with the other members of the panel assembly. Once the support members are engaged with the other members of the panel assembly, it is hard to disengage the support members from the other members, because of the mutual contact force of the mutually-adjacent panels and the curves thereof. For that reason, the support members do not come off the panel assembly even if a strong force is applied to the support members. Besides, the support members can be removably attached to the other members of the panel assembly very easily and simply, without making a hole in the panel assembly.

Other objects and features of the present invention will be apparent from the description herein and the drawings attached hereto.

DESCRIPTION OF PREFERRED EMBODIMENTS

Embodiments of the present invention are hereafter described in detail with reference to the drawings attached hereto.

Figure 1:
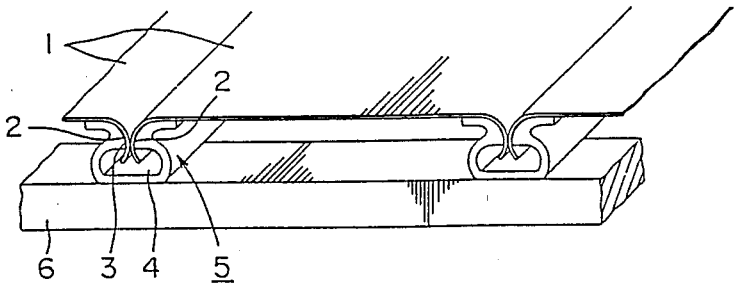
FIG. 1 shows a perspective view of a panel assembly which is an embodiment of the present invention.

FIG. 1 shows a panel assembly which is one of the embodiments, and comprises upper panels 1 curved as an arc convexly outward at both the side edges thereof and extending in the transverse direction of the panel assembly, and elongated coupler 5, each of which extends in the transverse direction of the panel assembly and has inner curved surfaces 2 which have curves corresponding to the arc-shaped curves of the upper panels but smaller in curvature than the arc-shaped curves and extend in the face of each other on the upper portion of the coupler so that a gap 3, into which two of the upper panels can be inserted, is defined between the inner curved surfaces and communicates with a cavity 4. It is preferable that the width of the gap 3 is about three times as much as the thickness of the upper panel 1. Each of the upper panels 1 is made of such an elastic material that the upper panel is easily curved downward at the intermediate part of the width thereof when the upper panel is supported at both the side edges thereof by a support means and pushed at the intermediate part of width of the upper panel. The curvature of the curved portions of each upper panel 1 at both the side edges thereof is such that the tangent on the lower curved portion of the upper panel at the side edge thereof extends vertically when the upper panel is subjected to the above-mentioned pushing.

Figure 2:
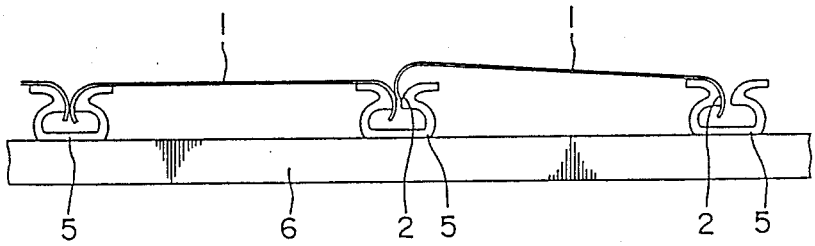
FIGS. 2 and 3 show views for describing a method of assembling the panel assembly.

When the panel assembly is to be assembled, the couplers 5 are first secured to optional support bodies 6 so that the distance between the couplers in the longitudinal direction of the panel assembly corresponds to the width of the upper panel 1, as shown in FIG. 2. A first upper panel 1 (which is the left-hand upper panel with regard to FIG. 2) is engaged with a first coupler 5 (which is the most left-hand coupler with regard to FIG. 2) and a second coupler 5 next thereto. At that time, the first upper panel 1 can be easily engaged with the first and the second couplers 5 by pushing the upper panel downward. In thereafter engaging of a second upper panel 1 with the second and a third couplers 5 next to the first coupler 5, the curved portion of the second upper panel at the right-hand side edge thereof is engaged with the left-hand inner curved surface 2 of the third coupler, and the curved portion of the second upper panel 1 at the left-hand side edge thereof is placed on the right-hand inner curved surface 2 of the second coupler. At that time, the curved portion of the second upper panel 1 at the left-hand side edge thereof comes into contact with the curved portion of the first upper panel 1 at the right-hand side edge thereof so that the curved portion of the second upper panel at the left-hand side edge thereof cannot be engaged with the right-hand inner curved surface 2 of the second coupler 5 by pushing the curved portion of the second upper panel at the left-hand side edge thereof. However, the second upper panel 1 is then pushed downward at the intermediate part of the width thereof so that the second upper panel is deformed and the tangent on the lower curved portion thereof extends vertically. As a result, the second upper panel 1 can be engaged with the right-hand inner curved surface 2 of the second coupler 5 by further pushing the curved portion of the second upper panel at the left-hand side edge thereof. A third and a fourth upper panels can be likewise engaged with the couplers 5.

If the tops of the couplers 5, which are engaged with the upper panels 1, are extended widely enough horizontally the upper panels are more stably supported.

If the volume of the cavity 4 of each coupler 5 is large enough, rain water does not leak down the panel assembly even though the rain water flows into the cavity through the narrow opening between the mutually adjacent surfaces of the upper panels 1 due to a capillary action.

Figure 5:
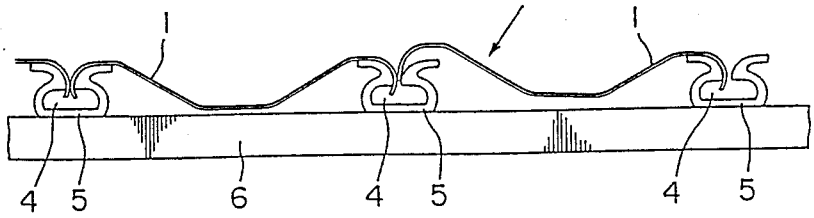
FIG. 5 shows a front view of a panel assembly which is another embodiment of the present invention.

As shown in FIG. 5, if each upper panel 1 is much bent downward at the intermediate part of the width thereof, rain water flows on the bent portion of the upper panel so that the rain water is less likely to flow into the cavities 4 of the couplers 5, thus making it possible to use the panel assembly as a large roof board.

The panel assembly can be used not only as a roof material but also as a wall material, a ceiling material or the like.

Figure 6:
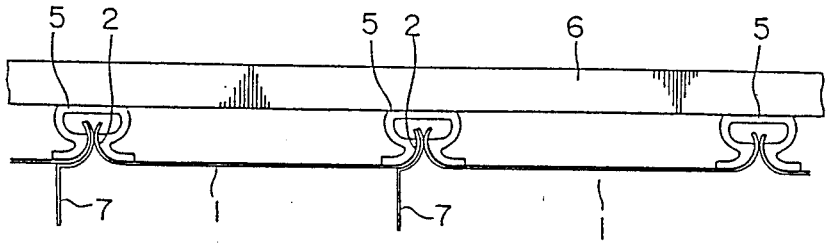
FIG. 6, 7 and 8 show front views of a panel assembly which is still another embodiment of the present invention.

FIG. 6 shows a panel assembly which is another one of the embodiments. The panel assembly has support members 7, each of which is made of a plate and curved as an arc at the butt thereof so that the curve of the support member coincides with the arc-shaped curve of each of panels 1. The curved portion of the support member 7 at the butt thereof is inserted in between two panels 1 inserted into the gap 3 between the inner curved surfaces 2 of a coupler 5. At that time, since the curved portions of the panels 1 on both the sides of the support member 7 at the butt thereof are deformed along the less-curved inner surfaces 2 of the coupler 5 so that an opening, into which the butt of the support member can be inserted, is defined between the panels, the butt of the support member can be easily inserted in between the panels.

Figure 7:
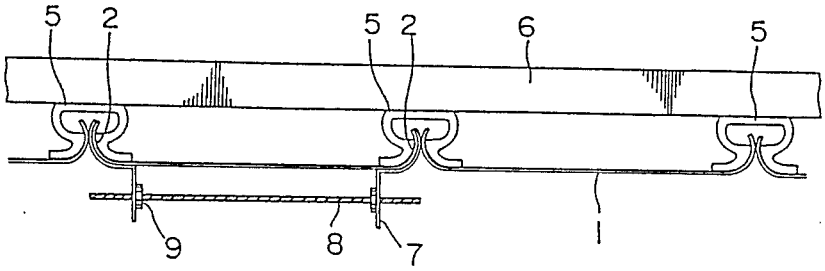
Figure 8:
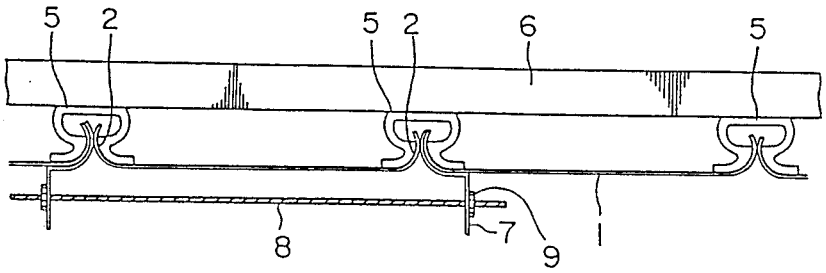

Because of the above-described constitution of the panel assembly shown in FIG. 6 and the contact force and curvature of the curved portions of the panels 1 and the support member 7, the support member cannot be pulled out of the gap 3 between the panels 1 even if a force is applied to the support member in the vertical downward direction or in the direction of the convexness of the curve of the support member at the butt thereof. For example, the support member 7 cannot be pulled out of the gap 3 by the force when the support member is 20 cm in width, 0.6 mm in thickness and 8 mm in radius of curvature and the force is about 100 kg. However, the support member 7 can be very easily pulled out of the gap 3 if a force is applied to the support member in the direction reverse to the convexness of the curve of the support member at the butt thereof. If it is necessary that a force does not act to the support member 7 in the direction reverse to the convexness of the curve thereof, another force should be always applied to the support member in the direction of the convexness of the curve thereof. For that purpose, two support members 7 are disposed in the face of each other and a bolt 8 is laid through them so that the curves of the support members at the butts thereof are convex outward, as shown in FIG. 7. Nuts 9 are engaged on the bolt 8 inside the support members 7 to apply restrictive forces thereto through the bolt in such directions as to increase the distance between the support members. Otherwise, two support members 7 are disposed in the face of each other and the bolt 8 is laid through them so that the curves of the support members at the butt thereof are convex inward, as shown in FIG. 8. In that case, the nuts 9 are engaged on the bolt 8 outside the support members 7 to apply restrictive forces thereto through the bolt in such directions as to decrease the distance between the support members.

Although FIGS. 6, 7 and 8 show the case that the panel assembly is used as a ceiling board, the panel assembly can be also used as a roof board because even if the rain water flows into the cavity 4 of the coupler 5 through the narrow opening between the mutually adjacent surfaces of the panel 1 and the coupler 5 due to a capillary action the rain water is prevented from flow down through the opening of the coupler 5 by the curved end of the panel 1 which is projected upwardly from the bottom surface of the cavity 4 of the coupler 5.

Figure 3:
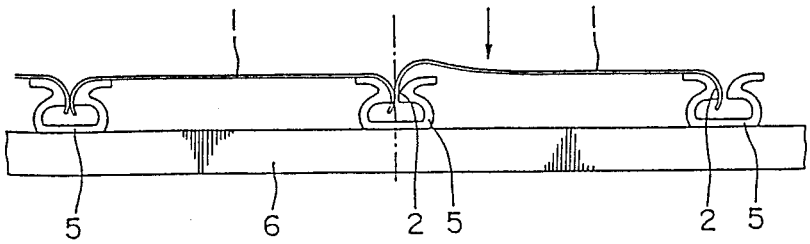
Figure 4:
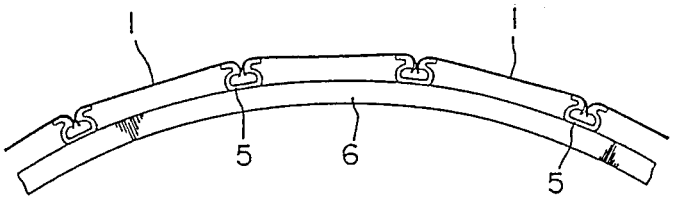
FIG. 4 shows a view for describing an example of mounting of the panel assembly.
Figure 9:
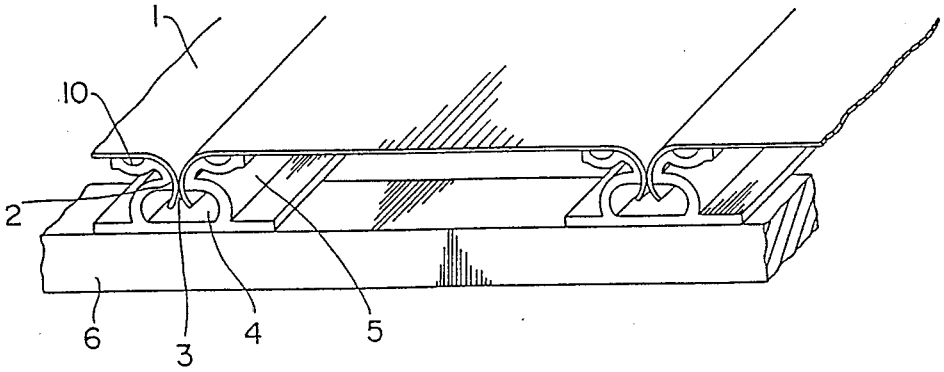
FIG. 9 shows a perspective view of a panel assembly which is still another embodiment of the present invention.

The panel assembly can be mounted upside down, as shown in FIGS. 1, 2 and 3. If the tops of the couplers 5, which are engaged with the panels 1, are extended widely enough horizontally and provided with recesses 10, as shown in FIG. 9, to use the panel assembly as the roof board, the panels 1 are more stably supported and rain water does not leak down the panel assembly even though the rain water goes up along the inner curved surfaces 2 of the coupler through the opening between the panel and the coupler due to a capillary action, because the rain water flows into the recess.

Figure 10:
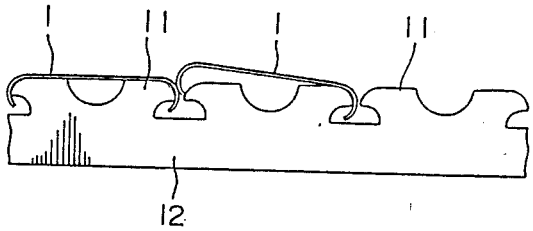
FIGS. 10, 11 and 12 show first views of a panel assembly which is still another embodiment of the present invention.
Figure 11:
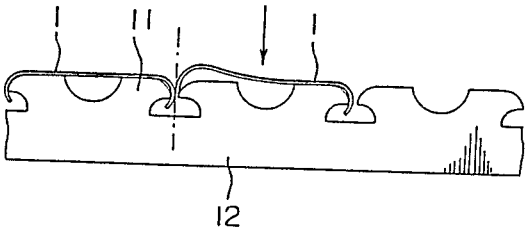

FIGS. 10 and 11 show a panel assembly which is still another one of the embodiments. In the panel assembly, upper panels 1 made of an elastic material and curved as an arc convexly outward at both the side edges of the upper panels are attached to pairs of inner curved surfaces 11 of stringers 12, each of which is provided with many pair of inner curved surfaces located at small intervals in the face of each other on the top of the stringer and corresponding to the arc-shaped curves of the upper panels.

Figure 12:
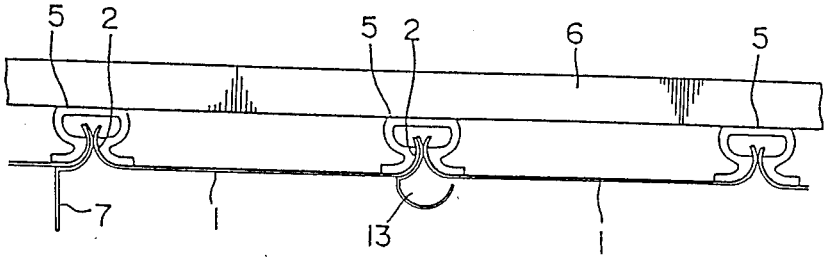

FIG. 12 shows a panel assembly which is still another one of the embodiments. In the panel assembly, a support member 7 is curved at the tip thereof so that the support member is formed with a gutter portion 13 in which an electric wire or the like is laid.

What is claimed is:

1. A panel assembly characterized by comprising a plurality of panels which are made of an elastic material and curved convexly outward at both the side edges of the panels and extend in the transverse direction of the panel assembly; support members having nearly semicircular curves coincident with the curves of the panels; and a plurality of couplers, each of which extends in the transverse direction of the panel assembly and has inner curved surfaces which have curves coincident with those of the panels and extend in the face of each other on the upper portion of the coupler so that a gap, into which the curved portions of two of the panels at the side edges thereof and the curved portion of the support member can be inserted, is defined between the inner curved surfaces, wherein two support members are disposed in the face of each other, a bolt is laid through them so that the curves of the support members at the butts thereof are convex outward, and nuts are engaged on the bolt inside the support members to apply restrictive forces thereto through the bolt in such directions as to increase the distance between the support members.

2. The panel assembly according to claim 1, wherein the tops of the couplers, which are engaged with the panels, are extended widely enough horizontally and provided with recesses.

3. The panel assembly according to claim 1, wherein said support member is curved at the tip thereof so as to form a gutter portion in which an electric wire or the like is laid.

4. The panel assembly according to claim 3, wherein said support member is curved at the tip thereof so as to form a gutter portion in which an electric wire or the like is laid.

5. A panel assembly characterized by comprising a plurality of panels which are made of an elastic material and curved convexly outward at both the side edges of the panels and extend in the transverse direction of the panel assembly; support members having nearly semicircular curves coincident with the curves of the panels; and a plurality of couplers, each of which extends in the transverse direction of the panel assembly and has inner curved surfaces which have curves coincident with those of the panels and extend in the face of each other on the upper portion of the coupler so that a gap, into which the curved portions of two of the panels at the side edges thereof and the curved portion of the support member can be inserted, is defined between the inner curved surfaces, wherein two support members are disposed in the face of each other, a bolt is laid through them so that the curves of the support members at the butt thereof are convex inward and the nuts are engaged on the bolt outside the support members to apply restrictive forces thereto through the bolt in such directions as to decrease the distance between the support members.

6. The panel assembly according to claim 5, wherein the tops of the couplers, which are engaged with the panels, are extended widely enough horizontally and provided with recesses.

* * * * *